US005173003A

United States Patent [19]

Hair

[11] Patent Number: 5,173,003

[45] Date of Patent: Dec. 22, 1992

[54] INTERLOCKING SLAB ELEMENT AND GROUND SURFACE COVER

[76] Inventor: Roberta A. Hair, 7554 Wooster Rd., Cincinnati, Ohio 45227

[21] Appl. No.: 754,278

[22] Filed: Aug. 30, 1991

Related U.S. Application Data

[63] Continuation of Ser. No. 619,901, Nov. 29, 1990, abandoned, which is a continuation-in-part of Ser. No. 504,044, Apr. 3, 1990, abandoned, which is a continuation of Ser. No. 238,496, Oct. 31, 1988, abandoned.

[51] Int. Cl.[5] ..... E01C 5/00

[52] U.S. Cl. ..... 404/41; 404/42; 52/604

[58] Field of Search ..... 404/34, 37–39, 404/41, 42; 52/596, 603, 604, 608

[56] References Cited

U.S. PATENT DOCUMENTS

| | | | |
|---|---|---|---|
| D. 42,404 | 4/1912 | Talamini . | |
| D. 42,405 | 4/1912 | Talamini . | |
| D. 75,761 | 7/1928 | Abraham . | |
| D. 82,970 | 1/1931 | Bolton . | |
| 400,974 | 4/1889 | Thorn | 52/610 |
| 449,739 | 4/1891 | Hazelton | 404/41 |
| 474,339 | 5/1892 | Graham | 404/41 |
| 1,595,686 | 8/1926 | Perry | 404/42 |
| 1,740,110 | 12/1929 | Oden | 52/98 |
| 2,025,496 | 12/1935 | Courtois | 404/41 |
| 2,323,848 | 7/1943 | Schaeffer | 404/42 |
| 2,340,526 | 2/1944 | Green | 404/42 |
| 2,919,634 | 1/1960 | Plotner | 404/42 |
| 3,494,266 | 2/1970 | Baumberger | 404/41 |
| 3,897,164 | 7/1975 | Dodino | 404/41 |
| 4,128,357 | 12/1978 | Barth et al. | 404/41 |
| 4,544,305 | 10/1985 | Hair | 404/41 |
| 4,651,486 | 3/1987 | Erickson et al. | 52/306 |

FOREIGN PATENT DOCUMENTS

| | | | |
|---|---|---|---|
| 2257219 | 5/1974 | Fed. Rep. of Germany . | |
| 2409188 | 9/1975 | Fed. Rep. of Germany | 404/41 |
| 2413566 | 10/1975 | Fed. Rep. of Germany . | |
| 2609234 | 9/1977 | Fed. Rep. of Germany | 404/42 |
| 2700088 | 7/1978 | Fed. Rep. of Germany . | |
| 2751536 | 5/1979 | Fed. Rep. of Germany . | |
| 3502793 | 8/1985 | Fed. Rep. of Germany | 404/41 |
| 3409114 | 9/1985 | Fed. Rep. of Germany | 404/41 |
| 874055 | 7/1942 | France . | |
| 2222488 | 10/1974 | France . | |
| 2376270 | 7/1978 | France . | |
| 70841 | 8/1952 | Netherlands . | |
| 6415356 | 6/1966 | Netherlands . | |
| 661054 | 5/1979 | U.S.S.R. . | |
| 9640 | of 1843 | United Kingdom | 404/42 |
| 610 | of 1853 | United Kingdom | 404/39 |
| 1416 | of 1868 | United Kingdom | 404/22 |

OTHER PUBLICATIONS

MacMahon, Major P. A., R.A. *New Mathematical Pastimes,* Cambridge University Press, 1921, pp. 55, 56.

Rampf Formen (14 pages).

Pictorial, 1983 National Concrete Masonry Association (pp. 1, 5).

*Primary Examiner*—Ramon S. Britts

*Assistant Examiner*—Roger J. Schoeppel

*Attorney, Agent, or Firm*—Wood, Herron & Evans

[57] ABSTRACT

A integrally molded paving stone or slab element of ceramic material, and a ground cover made up of repeatable patterns of such elements wherein the slab elements include a hexagonal section having two 90° and four 135° angles and lateral and longitudinal sides and a square section with a side adjoining a side of the hexagon which is adjacent one of the 90° angles. The lateral sides of the hexagon adjacent the 90° angles and the sides of the square are from 3.5" to 5", approximately and the longitudinal sides of the hexagon section are such that there are approximately 9" to 11" from one 90° angle to the other. Such a paving stone provides superior support for standard dual wheel truck loads when assembled in a ground cover.

18 Claims, 4 Drawing Sheets

INTERLOCKING SLAB ELEMENT AND GROUND SURFACE COVER

This is a continuation of U.S. Pat. application Ser. No. 07/619,901, filed now abandoned, which is a continuation-in-part of U.S. Pat. application Ser. No. 07/504,044, filed Apr. 3, 1990, which is a continuation of U.S. Pat. application Ser. No. 07/238,496, filed Oct. 31, 1988, now abandoned.

FIELD OF THE INVENTION

My invention is directed to uniquely shaped slab elements for covering the ground or other like surfaces, and to surface coverings composed of configurations of such elements. Specifically, my invention is directed to such slab elements, or paving stones, which can be combined with other like slab elements in a variety of different orientations to form stable load-carrying surfaces in a multiplicity of different patterns.

BACKGROUND OF THE INVENTION

The present invention is a new and improved slab element and ground surface cover arrangements of such elements. The invention provides many of the advantages of my previous invention entitled INTERLOCKING SLAB ELEMENT FOR COVERING THE GROUND AND THE LIKE disclosed in my U.S. Pat. No. 4,544,305, and, in addition providing other desirable and unique advantages and characteristics.

Slab elements of differing shapes have been employed in the construction of traffic-carrying surfaces such as roadways, footways, embankments and pool decks. Typically, the slab elements are made of concrete, formed in desired shape in molds, and cured under high pressure where the slab material is compacted and hardened into the desired shape in the mold, and removed from the mold and exposed to ambient air to complete the curing cycle. The method by which such slab elements can be made are well known in the art and form no part of my invention. Hence, methods for making slab elements will not be addressed further except to note that the shape of the molds used to form prior art slab elements must be modified so as to conform to the shape of my slab elements.

To construct a surface employing slab elements, an under-surface is prepared in known fashion to provide a smooth flat surface upon which to place the slab elements. The slab elements are placed one at a time such that their vertical or peripheral walls or edge faces come into close contact. The gaps between edge faces may be filled either with mortar, concrete, or other such solidifying spacer element, or, preferably, with sand which is simply poured into the gaps in a known manner. My invention is ideally suited to the latter, less costly method. The traffic load encountered by surfaces constructed in the above manner can vary from as light as pedestrian traffic to as heavy as several ton trucks and forklifts.

Slab elements employed for traffic surfaces have come in a wide variety of shapes from square and rectangular to multi-sided and irregular shaped surfaces, but a slab element's shape is known to affect the ground cover's load carrying capacity and durability. When viewed from the top, such slab elements generally fall into one of three basic categories.

The first category is a slab element which has a known and simple geometric shape, such as a rectangle, a square, a hexagon, or an octagon. From an aesthetic point of view, this category of elements is highly desirable and has historically been in great demand. In other respects, this category has heretofore been less desirable than other categories hereinafter discussed because such shapes preclude an interlock joint between adjacent slab elements. Additionally, proper utilization can require greater material and care than other slab elements and are often not satisfactory in use. For example, if such slab elements were placed in the manner expected of my invention, i.e., with sand between them, the surface would not be stable because there is no interlock. Furthermore, because there is no interlock, long, straight channels are more easily formed between the elements thus permitting rain, for example, to wash away the sand further reducing the load carrying stability of the ground cover formed with those elements. Hence, such slab elements would typically require mortar or concrete between elements. Mortar or concrete are typically more expensive than sand and are more difficult to work with.

A second category of slab element is one wherein, from a top plan view, the slab element looks substantially rectangular but the edges are deformed in such a manner as to interlock when laid next to an adjacent, identical stone. Examples of second category slab elements are shown in U.S. Pat. No. 2,919,634 and U.S. Pat. No. 3,494,266. Also included in this category are certain multi-faced irregularly shaped slab elements such as those disclosed in U.S. Pat. No. Des. 82,970. The slab elements disclosed in the aforementioned patents overcome some of the drawbacks of slab elements discussed in the preceding paragraph because they may be interlocked. However, they are less attractive from an aesthetic standpoint. Moreover, the slab elements in this category generally may not be intermixed with other differently shaped second category slab elements as would be possible with first category slab elements to permit a wide variety of patterns to be created.

A third category of slab element, and the one with which my invention is concerned, overcomes the drawbacks of both first and second category slab elements. A third category slab element is comprised of two or more sections having the shape of first category slab elements which are combined into one integral slab element. An example of such a slab element is disclosed in U.S. Pat. No. 4,128,357. The slab element of that patent has a main section which is of a known octagonal shape, and a tail section which is of a known square shape, with the main and tail sections being formed as one slab element. The primary advantage of such an integral slab element is that it can interlock for durability and stability. A disadvantage, however, is that it is susceptible of only a few different interlocking patterns.

In German Patent No. 3,409,114 to Koelling, a variety of patterns are provided with the use of several individual stones of differing shapes, including squares and hexagons. Not only does such a combination of stones require plural stones of different shapes, which is undesirable, but such combination produces a surface which presents problems when subjected to heavy loads, particularly the loads of conventional large trucks, as for example, those having standard dual H-20 wheels.

In my U.S. Pat. No. 4,544,305, I have disclosed a slab element for use in providing a ground cover particularly suited for use filling the joints with sand. In my prior patent, I have taught that the combined shapes of a square and hexagon could be used to form such a slab element when the hexagon has two pair of minor faces equal to those of the square, each pair joined by a right angle with the pair being joined together by two major faces each twice the length of a minor face, the square being joined at a minor face.

In integrating a paving surface pattern into an architectural or landscaping plan, certain designs call for surfaces with the more classical appearance of patterns which are built upon the more regular basic shapes of squares and hexagons. Such patterns are illustrated in British patents of Crannis et al No. 9640 and Dodgson No. 610, German Patent No. 27-51-536. As I have pointed out in my previous U.S. Pat. No. 4,544,305, slab elements combining these shapes for use in a variety of interlocking patterns cannot be easily selected. Where an objective is, however, to provide an interlocking paving element of brittle ceramic material such as concrete, certain other practical problems are presented.

In the art of roofing, for example, where flexible materials are employed, plural square or hexagon shapes can be joined in an integrated covering element with less concern for the structural problems by joining brittle materials, for example, as shown in Abraham U.S. Pat. No. D75,761. In arts requiring ceramic materials, particularly for the formation of thinner tile-like rather than thick block-like elements, the avoidance of thin elongated elements and elements with acute external or internal angles adds to the strength of the element, reduces the incidence of element breakage in manufacture, storage, handling, assembly and use, and enhances the ease of manufacture.

The usual applications for paving stones are aesthetic. The working loads on such pavements are normally pedestrian or light wheel traffic, e.g., automobiles, and for this level the shapes, sizes, colors and thicknesses (usually 60 mm) can be as varied as the customer wishes and can afford. Most such applications are hand-laid, hence the stones are within the 4–6 kg weight and dimensional size that can be comfortably handled in manual placement. The stones specified in my U.S. Pat. No. 4,544,305 and the above-mentioned German Koelling patent are primarily designed for forming a wide variety of visually pleasing geometric patterns.

The paving stone of the present invention is an interlocking stone, which, when subjected to heavy truck wheel loading, is capable of retaining a continuous, smooth plane surface and withstands fracture forces. The stones of my U.S. Pat. No. 4,544,305 and of the German Koelling patent, even though superficially resembling, or producing patterns resembling, those of the present invention, are not satisfactorily capable of heavy truck wheel service. Further, these stones cannot be made capable of satisfactorily withstanding such loads by mere enlarging or reducing the size of the stones, due to unobvious shortcomings in their geometries.

The stone of my U.S. Pat. No. 4,544,305 can create a very large number of varied patterns using only a single style of stone. Its elongated shape, however, limits its inherent load bearing acceptability regardless of the size at which it is made. The Koelling stone set requires several different shapes to create similar or equal patterns. Here too, regardless of the size of these stones, the mere differences in the sizes inhibits the load bearing adaptability of these stones.

SUMMARY OF THE INVENTION

It is a primary objective of the present invention to provide a tile-like interlocking paving element utilizing to a maximum extent the nearly regular appearing design shapes of hexagons and squares in an integrated slab element while preserving and extending, to the maximum extent possible, the advantages of my present invention of U.S. Pat. No. 4,544,305. By regular, I refer to component shapes having equal sides and equal angles, or at least having sides and angles which are close enough in size so as to be perceived as equal or have the same aesthetic appearance as if they were equal.

It is another objective of the present invention to provide such a paving element which avoids acute angles and elongated shapes, and which is shaped not only to provide the aesthetic requirements set forth above, but to avoid shape characteristics which undermine its strength and resistance to breakage. It is a further objective of the present invention to provide such a paving element which can be arranged in a ground cover pattern which fully covers the surface without the use of irregular pieces and which is suitable for a wide range of designs and patterns using minimal irregular or multiple shaped elements.

It is a more particular objective of the present invention to provide a paving which fully covers the ground with a stone of a single size and shape which provides pattern versatility, and which will support heavy vehicular loads, such as those imposed by trucks with standard dual H-20 wheels, while maintaining a level continuous, smooth surface, avoiding irregular vertical displacement or shifting, and without cracking of the stones.

These objectives are accomplished by providing a seven sided tile-like paving integrated element having a hexagon portion which is virtually equilateral with a pair of opposed 90° angles separating the lateral sides of the hexagon, and having a square portion adjacent one of the lateral sides. By virtually, equilateral, I mean with sides that will be perceived as equal in length to give the hexagon shape a regular rather than elongated appearance.

Another objective of my invention is to provide a slab element which lends itself to forming a large number of different, attractive, interlocking patterns. This objective is accomplished by providing a slab element which has a main hexagonal section and one tail section integral therewith which are oriented substantially in one plane. The main section has a first pair of adjoining lateral peripheral edges or faces and a second pair of adjoining lateral peripheral edges or faces with the first and second pairs of lateral peripheral edges or faces being oppositely disposed in spaced-apart relationship. The main section further has a pair of spaced apart, parallel longitudinal peripheral edges or faces interconnecting the first and second pairs of lateral peripheral faces. The faces of each pair are joined at right angles. The tail section has four lateral peripheral faces or edges, with one of the four lateral faces of the tail section being substantially coextensive in size and shape and spacially coincident with one of the lateral faces of the main section. Each of the longitudinal faces is approximately equal to the length of the lateral faces, and the intersection of each longitudinal face with the adjoining lateral face defines an angle of approximately 135°. The lateral faces of the tail section define substantially a square. The lateral face adjacent to the lateral face at which the square tail section is joined lies in the plane of one side of the square and with it forms a single side of the slab element.

According to the preferred embodiment of the present invention, the stone is formed of an integral molded piece of ceramic material such as concrete. The shape of the stone is defined by a hexagonal section and a square section with the thickness of the stone being less than half of the greatest dimension of the stone. The hexagonal section has a periphery formed of six vertical faces, including four identical lateral faces and two identical longitudinal faces. The four lateral faces are disposed as two opposing pair of adjacent lateral faces with the lateral faces of each pair forming an internal angle of approximately 90° with the other. The lateral faces having equal lengths of from approximately 3½ inches to approximately 5 inches, preferably about 4 inches. The two longitudinal faces each form, at opposite ends thereof, an angle of approximately 135° with one of the lateral faces of each pair, to thereby define a hexagon. The longitudinal and lateral sides have lengths such that the hexagonal section, measured from one 90 angle to the other, is from approximately 9 inches to approximately 11 inches in length. With the lateral faces 4 inches in length, the longitudinal faces are also preferably about 4 inches in length. The square section has a periphery of four vertical faces each having a length equal to the length of the lateral faces of the hexagonal section. The square section has one of its vertical faces lying in the plane of one of the lateral faces of the hexagonal section such that the vertical faces of the square section adjacent the plane form external angles of 135° and 180°, respectively, with the respective longitudinal and lateral faces of the hexagonal section adjacent the plane.

The paving stone of the present invention is capable of producing a complete ground cover using only a single shape, but the stipulation that the longitudinal sides be less or other than twice the lateral sides considerably reduces the number of patterns that can be achieved, compared to that of my U.S. Pat. No. 4,544,305 and the Koelling patent, which are their primary objectives.

The stone of the present invention is capable of maintaining a level and continuous surface under heavy loads, particularly truck loads, such as the loads from the H-20 wheel loading standard, without vertical displacement or, alternatively fracture of the stones. The stone of the present invention is structurally superior to the stones of my prior patent and the Koelling patent, and of stones larger or smaller size or differently proportioned, particularly in its ability to support heavy truck loads.

By means of the foregoing angular and length relationships of that peripheral face, adjacent slab elements can be arranged in a wide variety of orientations relative to each other to provide many different interlocking patterns. In addition, and importantly, the elements form a structurally strong design particularly suitable for interlocking paving elements of concrete or other ceramic material and present an appearance of a versatile hexagon and square design.

BRIEF DESCRIPTION OF THE DRAWINGS

FIG. 1 is a front perspective view of a first preferred embodiment of a slab element of my invention for covering the ground and the like.

DETAILED DESCRIPTION OF THE PREFERRED EMBODIMENTS

Figure 1:
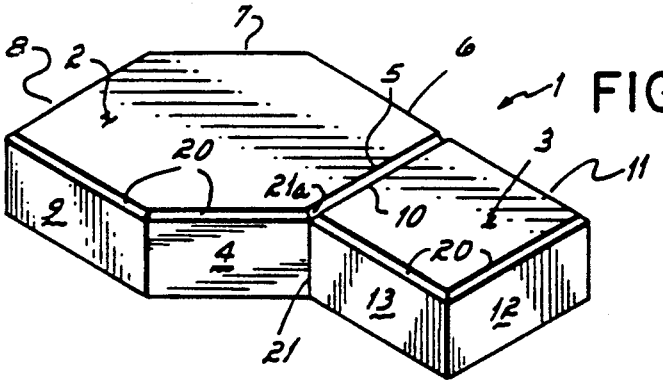

With particular reference to FIGS. 1 through 5, there is shown a slab element 1 comprised of a main hexagonal section 2 and an integral square tail section 3. The main hexagonal section 2 is comprised of four lateral and two longitudinal faces or edges 4 through 9 around the periphery thereof. First longitudinal face 4 adjoins a lateral face 5, which is internal, to form an included angle 14 of approximately 135°. First lateral face 5 adjoins a second lateral face 6, which is exposed, to define an included angle 15 of approximately 90°. Second lateral face 6 adjoins a second longitudinal face 7, also exposed, to define an included angle 16 of approximately 135°. Second longitudinal face 7 adjoins third exposed lateral face 8 to define an included angle 17 of approximately 135°. Third lateral face 8 adjoins a fourth exposed lateral face 9 to define an included angle 18 of approximately 90°. Fourth lateral face 9 adjoins the first longitudinal face 4 to define an included angle 19 of approximately 135°. Each of the lateral faces 5, 6, 8 and 9 are equal in length, of from approximately 3.5" to 5" in length, and preferably about 4" in length. Major, or longitudinal, faces 4 and 7 are equal in length, and of a length such that the overall length of the hexagonal section is from about 9 to about 11 inches measured from the points of the 90° angles. That is to say, the length of a longitudinal section, plus the product of the length of the lateral section and the square root of 2, is between approximately 9" and 11". With the lateral sections about 4" in length, the longitudinal sections are preferably also about 4" in length and each equal to the length of the lateral faces 5, 6, 8 and 9. The faces 4, 5, 6, 7, 8, and 9 lie in planes which are substantially perpendicular to the planes containing the upper and lower surface 1*a* and 1*b*, respectively, of the slab elements.

The tail section 3 is comprised of four adjoining faces 10, 11, 12 and 13 around the periphery thereof, each of which is equal in length to that of the faces 4, 6, 8 and 9 of the hexagonal main section 2. The four tail section faces 10, 11, 12 and 13 preferably define substantially a square when viewed from the top as in FIG. 3. Of faces 10, 11, 12 and 13, only face 10 is internal to the stone; the others are exposed.

The square or tail section 3, which is integral to hexagonal main section 2 to form the slab element 1, adjoins at its lateral internal face 10 the hexagonal main section 2 along first lateral internal face 5 thereof. Face 10 and first lateral face 5 are substantially coextensive in size and shape and spatially coincident with each other such that no portion of either of those faces extends beyond the other. The vertical plane along which lateral face 10 and first lateral face 5 spatially coincide is indicated by reference numeral 21. Face B joins face 4 to form an external 135° angle therewith. Faces 11 and 6 are adjacent and may be viewed as two faces joined at 180° angle along one edge forming a common face of the stone.

Figure 2:
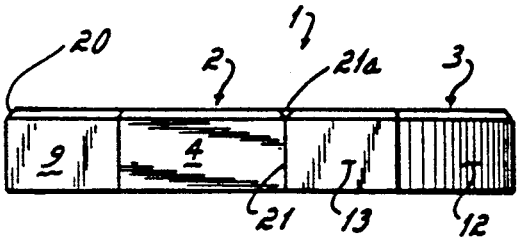
FIG. 2 is a front elevational view of the slab element of FIG. 1.
Figure 3:
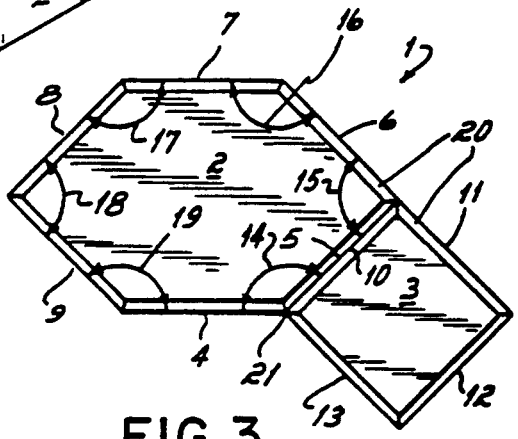
FIG. 3 is a top plan view of the slab element of FIG. 1.

In my preferred embodiments, the upper edge of each face of each main and tail section is chamfered as indicated by reference numerals 20, 20. The chamfer is preferably 6 mm. in height and 4 mm. in depth and, as shown in FIG. 2, starts inwardly from the outer wall of the face towards the interior of its respective main or tail section 2 or 3. When the slab element 1 is thus provided with chamfers 20, upper edge 21*a* of plane 21 may be viewed as a false joint in which case two identifiable polygons of known shape, namely, a hexagon and a square, are clearly discernible in slab element 1 as is especially shown in FIG. 3.

Figure 4:
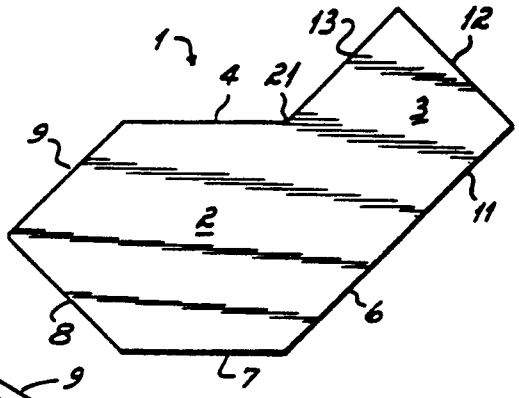
FIG. 4 is a bottom plan view of the slab element of FIG. 1.
Figure 5:
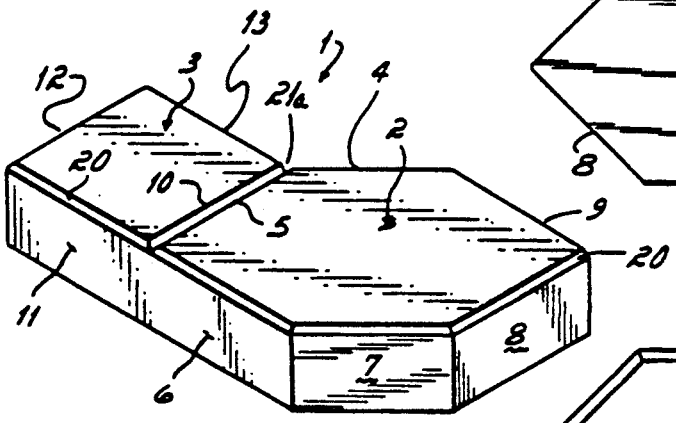
FIG. 5 is a rear perspective view of the slab element of FIG. 1.

Alternately, slab element 1 need not be provided the chamfers 20 and would then appear as in the bottom plan view of FIG. 4.

As seen in FIG. 2, the slab element 1 is a tile-like slab with a width and length greater than its thickness, its thickness being preferably less than half the largest or longitudinal dimension of the element. This is in contrast to block-like elements as shown in Graham U.S. Pat. No. 474,339 and Dodgson British No. 610.

Figure 6:
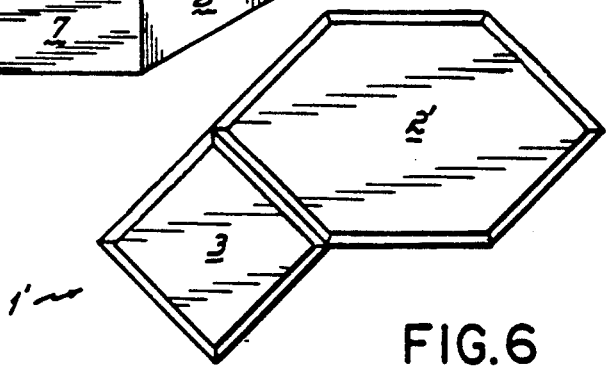
FIG. 6 is a top plan view similar to FIG. 3 of a mirror image of the slab element of FIG. 1 and is another preferred embodiment of a slab element according to my invention.

In order to provide an even further variety of design from that available with the slab element 1 shown in FIG. 1, an alternative preferred embodiment generally depicted as 1' is provided as shown in top plan view in FIG. 6. Slab element 1' is identical in all respects to slab element 1 except it is a mirror image thereof. Alternatively, slab element 1' could be obtained by providing slab element 1 with chamfers 20 on both the upper edge as shown as well as along the bottom edge (not depicted) and turning slab element 1 over. Providing a slab element 1 having chamfers 20 along the upper edge and the bottom edge eliminates the need for an alternative slab element 1', but is not generally desirable in that false joint 21 will be created on both the top and the bottom of the slab element creating unnecessary stress concentrations and leaving less material to maintain the two sections as one integral element. Such weakening at the false joint is not desired in that the slab element could break more easily at the joint 21*a* under the stress of a heavy load, thereby losing the interlock feature sought by my invention. Moreover, having chamfers 20 along the bottom edge of slab element provides an opportunity for the sand between the slab elements to slowly fill the crevices left by the chamfers on the bottom, causing the slab elements to come loose or have less stability when they are provided in an overall pattern to cover the ground as contemplated by my invention.

As more fully discussed hereinafter, a ground cover may be made by using any substantially L-shaped slab element comprised of two or more different integral sections of simple geometric shape which meet certain dimensional criteria. When such L-shaped sections are disposed in a common plane, adjacent slab elements are capable of having a wide variety of orientations with respect to each other and can result in a vast number of different interlocking patterns. However, to satisfy the criteria of my present invention, the slab element must meet the following dimensional criteria with respect to included angles and length of faces:

(A) The slab element must be generally L-shaped and comprised of two integral sections, one a hexagon and one a square;

(B) Each included angle of each section must be either 135° or 90° ;

(C) The length of each face of each section must be such that the lateral faces are from approximately 3.5" to 5" in length and, when multiplied by the square root of 2 and added to the length of the longitudinal sides, is between approximately 9" and 11";

(D) The internal spatially coincident faces of adjoining sections must be coextensive in size and shape;

(E) The square section must adjoin a side of the hexagonal section which is adjacent a 90° angle of the hexagon.

When these criteria are satisfied, the resulting element 1 will be a seven sided figure, with two faces 4 and 13 having merged into one coplanar surface.

FIGS. 7 through 14 show some of the many varied patterns of ground covers which can be obtained by using slab elements 1 and/or 1' of my invention. The chamfers 20 and dummy joints 21*a* have been omitted to facilitate an understanding of the manner in which the patterns may be created, but it is to be understood that it is preferred that elements with such chamfers and dummy joints be employed. In the edgers 115 and 116, the main section 2 of a slab element 1 has been modified to main section 2*a* or 2*b*, respectively. It should be readily apparent that edger elements may be useful to finish certain patterns and may be created by eliminating any part of a section along a line formed between two confronting face intersections. Also, preformed edges are preferable to breaking a complete slab element 1 as that could lead to frayed edges and weakened elements.

Figure 7:
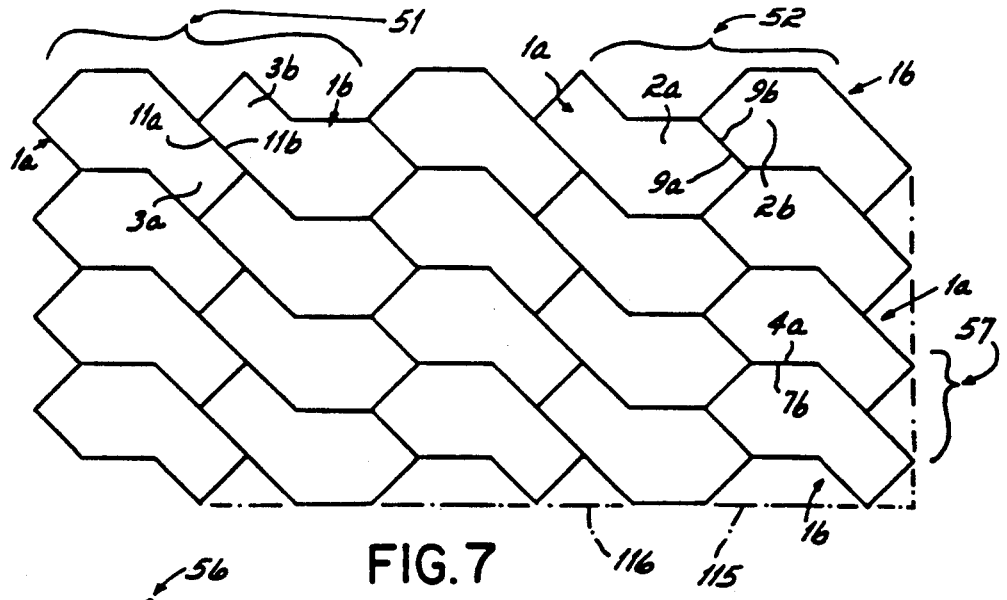
FIG. 7 is a top plan view of a repeating first closed pattern with the slab elements of FIG. 1.
Figure 8:
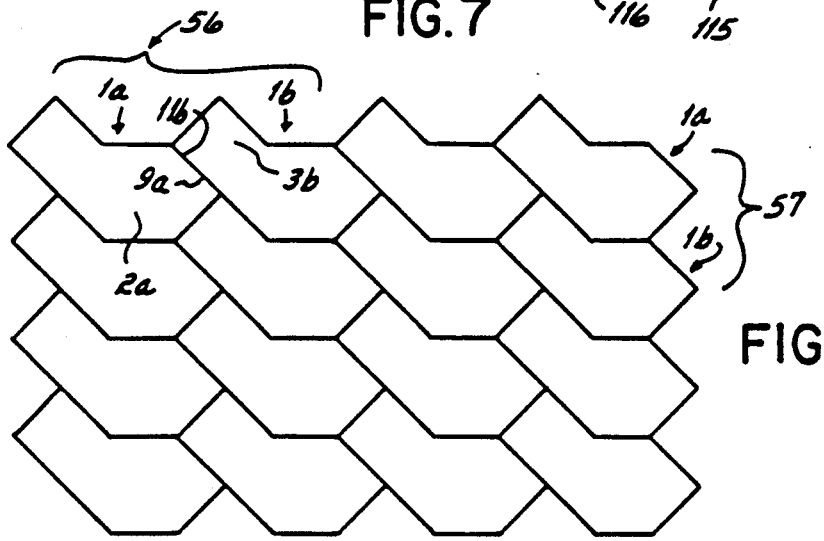
FIG. 8 is a top plan view of a repeating second closed pattern with the slab elements of FIG. 1.
Figure 12:
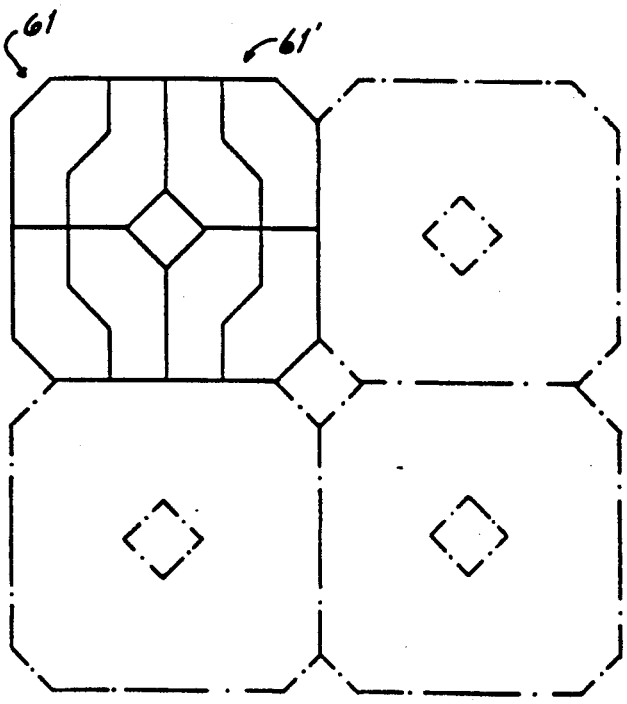
FIG. 12 is a top plan view of a repeating first open pattern with the slab elements of FIG. 1 and FIG. 6.
Figure 13:
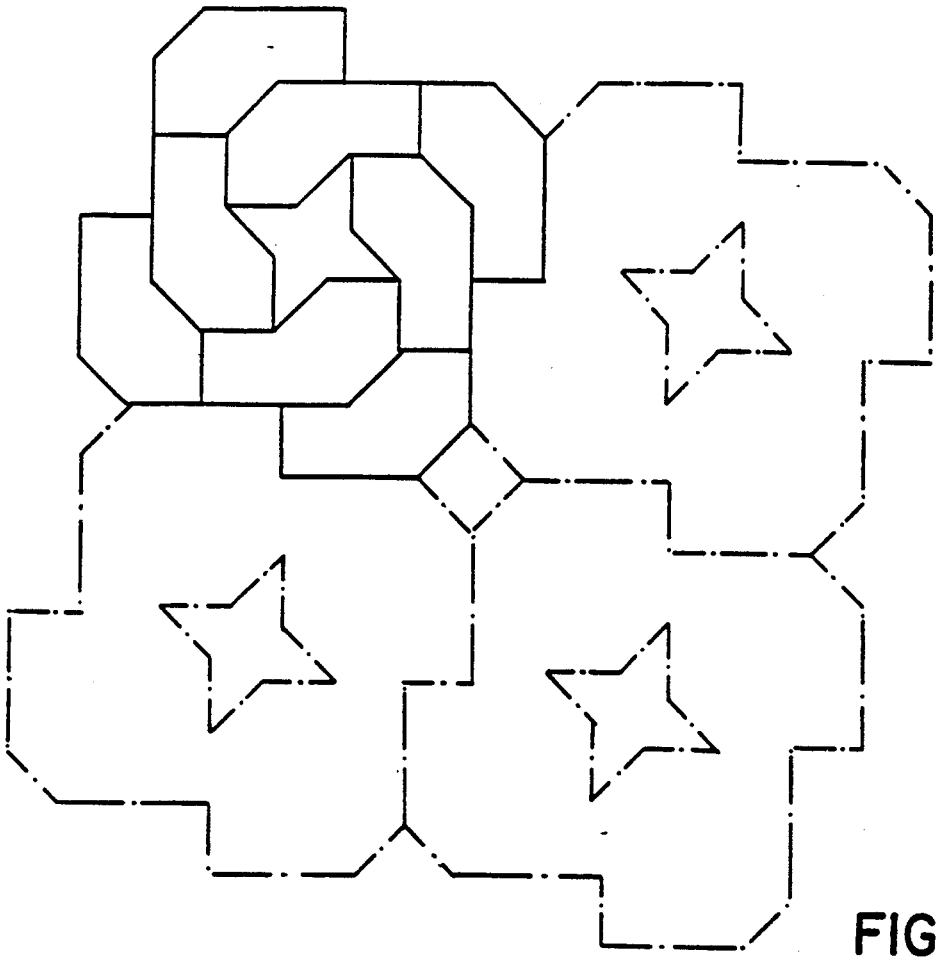
FIG. 13 is a top plan view of a repeating third open pattern with the slab elements of FIG. 1.
Figure 14:
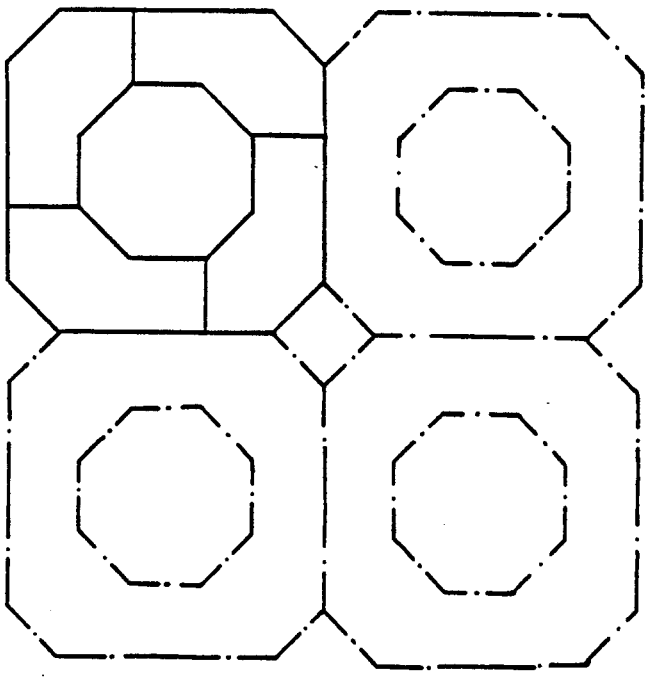
FIG. 14 is a top plan view of a repeating fourth open pattern of slab elements of FIG. 6.

Typically, the slab elements of my invention will be employed to form one of two types of patterns which I refer to as closed or open patterns. Examples of closed patterns are shown in FIGS. 7 through 11. I have used the term closed pattern to mean that there is no opening in the center or in any interior region of the pattern. Conversely, I have used the term open pattern to refer to patterns such as are shown in FIGS. 12 through 14, in which there is at least one opening in the interior of the patterns. Furthermore, a pattern is repeating where one or more repeaters, as hereinafter described, repeat in similar orientation. As will be more fully understood by reference to the drawing figures, there are a number of basic "repeaters" which are employed in all of the above patterns whether open or closed. These repeaters consisting of two of my slab elements 1 and/or 1' in a particular adjoining relationship. For example, a first repeater is indicated generally at 51 in FIG. 7. First repeater 51 consists of two slab elements 1*a* and 1*b* in a common plane wherein lateral faces 11*a* and 11*b* of tail sections 3*a* and 3*b* are located proximate to each other. Similarly, second repeater 52 consists of two slab elements 1*a* and 1*b* in a common plane wherein lateral faces 9*a* and 9*b* of main sections 2*a* and 2*b* are located proximate to each other. As can readily be seen in FIG. 7, using a multiplicity of first repeaters 51 and second repeaters 52 results in the repeating first closed pattern 50. Upon further inspection, a third repeater 57 may be seen in FIG. 7. Third repeater 57 consists of two slab elements 1*a* and 1*b* in a common plane and in which longitudinal face 4*a* of slab element la is located proximate to longitudinal face 7*b* of slab element 1*b*. Third repeater 57 may be employed as was done in FIG. 7 by making rows of third repeaters 57 which alternate between right side up and rotated 180°. Similarly, rows of third repeaters 57 may be employed wherein all third repeaters have the same orientation as is shown in FIG. 8 as a repeating second closed pattern 55. Also shown in FIG. 8 is a fourth repeater 56 which consists of two slab elements 1*a* and 1*b* in which lateral face 9*a* of main section 2*a* of slab element 1*a* is located proximate to lateral face 11*b* of tail section 3*b* of slab element 1*b*. A fifth repeater 61, shown in FIG. 9, consists of two slab elements 1*a* and 1*b* in which longitudinal faces 4*a* and 4*b* of slab elements 1*a* and 1*b*, respectively, are located proximate to each other while their tail sections 3*a* and 3*b* are spaced away from each other.

Figure 10:
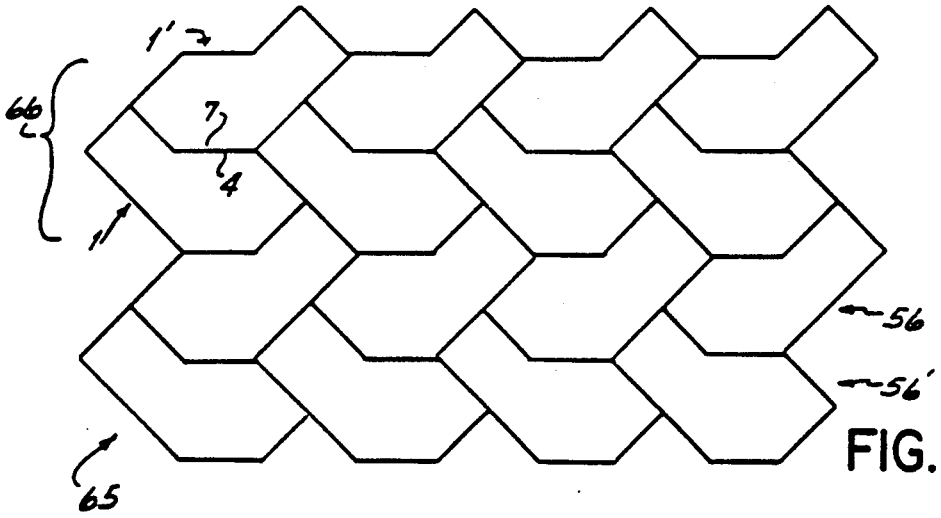
FIG. 10 is a top plan view of a repeating fourth closed pattern with the slab elements of FIG. 1 and FIG. 6.

Sixth repeater 66 is shown in FIG. 10 and, when employed in a repeating fourth closed pattern 65, also utilizes fourth repeaters 56 and 56'. Sixth repeater 66 consists of one slab element 1 and one slab element 1' wherein the first longitudinal face 4 of slab element 1 is located proximate to second longitudinal face 7 of slab element 1'. Fourth repeater 56' is virtually identical to fourth repeater 56 except that the former is made with slab elements 1' rather than slab elements 1.

Figure 11:
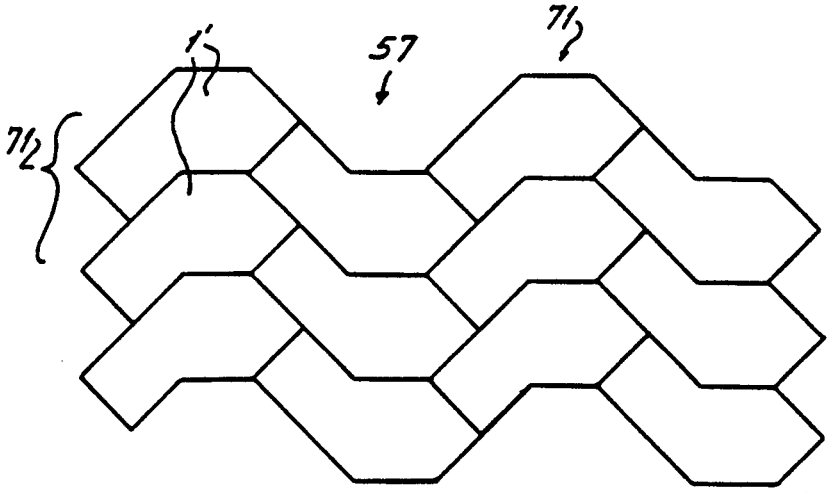
FIG. 11 is a top plan view of a repeating fifth closed pattern with the slab elements of FIG. 1 and FIG. 6.

As shown in FIG. 11, a fifth closed pattern 70 may consist of alternate repeaters 57 and the mirror image slab elements 1' as shown at 71. Other repeaters may be employed with my invention, but I have chosen to illustrate only some of those repeaters for simplicity.

The varied patterns exemplified in FIGS. 7 through 13 employ a large number of slab elements disposed in a common plane with faces of each of most of those slab elements proximately located relative to faces of at least four other slab elements. That the above relationship is met is borne out by examination of any one of the several slab elements contained in the interior, as opposed to the periphery, of the above patterns and the proximate relationship had with the neighboring slab elements.

The slab element of the present invention does not lend itself to the same pattern variations of that disclosed in my prior U.S. Pat. No. 4,544,305, but provides an element for forming other attractive designs, particularly those of the more classic type which have the appearance of comprising regular hexagons and squares. Even a pattern providing imbedded regular octagons as shown in FIG. 14 is possible. While actually the hexagon segments of my slab elements are not true regular hexagons, it has been found that use of an equilateral hexagon where the angles include 90° and 135° angles creates a perception of regular hexagons to most observers. Additionally, making an opposed two of the angles of a regular hexagon equal to 90° and the other four equal to 135°, with an integral square section adjacent one of the lateral sides forming the 90° angle provides for closed interlocking patterns and for structural enhancement over the prior art, which are among the intended advantages set forth above. Such a pattern is one which is simple to cost of concrete or other such material and is one which is not as prone to breakage as other shapes.

Figure 9:
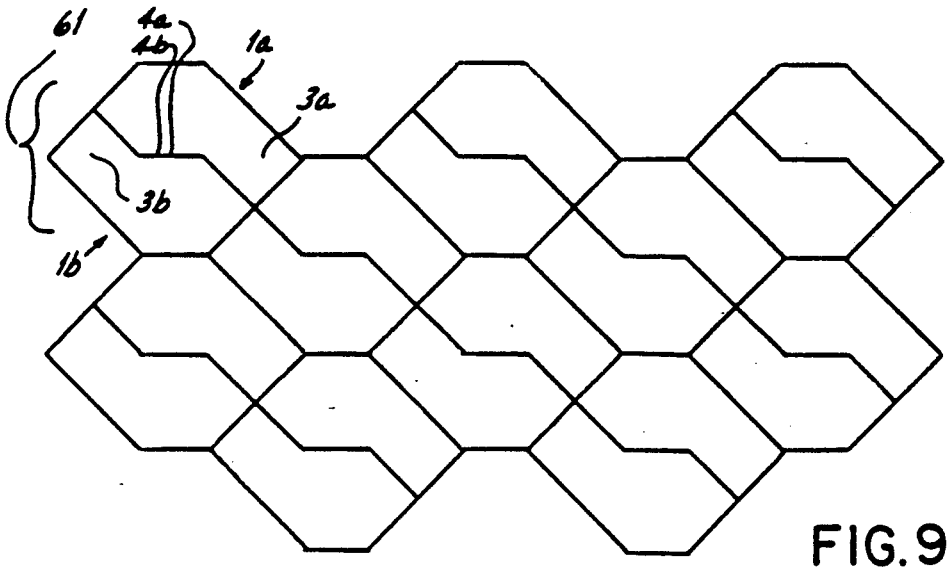
FIG. 9 is a top plan view of a repeating third closed pattern with the slab elements of FIG. 1.

Important features of the stones of the preferred embodiment of the present invention are those that make it capable of forming a ground cover which will support heavy truck loads such as those to which it would be subjected under with vehicles with standard H-20 dual truck wheels. Patterns which best support such loads with are those shown in FIGS. 7–11. The patterns of FIGS. 7–9 are, however, preferred because they can be made with a stone of a single shape, where those of FIGS. 10–11 require right and left handed versions of the same stone. The pattern of FIG. 9 is believed to be the best for heavy load bearing pavement surfaces.

It is generally understood that an H-20 dual truck wheel must carry 16,000 lbs. of live load plus 30% for impact on a dual wheel "footprint" 10"×20" (known as the AASHTO specification), i.e., a 41,600 lb. axle load. The tire treads on such wheels are 8" wide with a 4" space between them due to the shape of the tire. The area in contact with the pavement extends 10" front to back, so a load of 10,400 lbs. is incurred under each 8×10" tire "footprint."

It is believed that the stone of the present invention is superior to prior art stones for the general reasons. A 10"×20" tire footprint must support a loading of 130 lbs/sq. in., which exceeds the 30 psi bearing capacity of well compacted dry soil. Accordingly, a single paving stone placed directly on 30 psi soil would have to have an area of 347 sq. in. to carry the 10,400 lb. load without sinking into the soil. An 18.6+ inch square paving stone would have such area, but a stone of thickness normal to the trade would crack under H-20 wheel loading because of the uneven load by the rolling wheels. Furthermore, an 18.6" square stone would have to carry nearly twice the load because its size permits two tires to bear on it simultaneously. The 18.6" square would weigh 97 lbs., too heavy for manual placement. By contrast, an 1,000 lb. automobile tire load can be carried on a 6×6 (36 sq. in) stone laid on 30 psi soil without significantly indenting the soil.

Unlike the large area of monolithic reinforced concrete required to carry high volume truck traffic and have joints 50–60 ft. apart, a paving stone roadbed has many joints. Rainwater inevitably percolates through these joints and down through the gravel base to the soil. Wet soil has far lower bearing capacity than dry soil, so that the assumption of a 4,000 psi soil load bearing capacity cannot be made in engineering design, but rather a value of 1500–2000 psf would be more realistic. The probability that the stones will be fractured by the rolling wheel load is minimized where the ratio of length to breadth is close to the 8×20 ratio of the tire footprint, because as the wheel comes on to the stone, it causes a rocking action that is countered by the interlocking action between stones, thereby creating severe tensile or fracture stress in the cross-section of the stone.

When the 8"×10" tire footprint is centered on the stones that comprise 80 sq. in. of bearing surface, the load is transmitted downward, and develops a pattern on the soil. As the full load of the tire reaches center on the stone cluster, the pressure driving the gravel into the soil sub-base is maximum at the edges of the vertical projection of the loaded stone pattern and the vertical surfaces of adjacent stonages cannot contribute support.

The downward pressure exerted by the stones also has a lateral component on cohesionless material which causes the gravel around the perimeter of the loaded stones to bulge upward, much like a person's footprint in the sands of an ocean beach. This tends to raise the adjacent edges of the unloaded stones just prior to becoming loaded by the on-rolling tire footprint. The result is a rocking action on the succession of stones the tire traverses. Though each traverse produces only a small displacement, the effect is cumulative. Stones sized and shaped to act as unity, and having as large an area on the vertical surfaces as possible, obtain maximum frictional resistance to displacement from the stones adjacent on the perimeter of the footprint load.

In addition to the above, the forces of the rolling load exert a tensile stress in the stones. As the vertical centerline of the tire comes to the edge of the stone, most of the wheel load is momentarily concentrated on the edge of the stone. This magnifies the tipping or rocking action which is resisted by the interlocking of the opposite edges of the stone with its neighboring stones. The result is a severe tensile stress developed just ahead of the leading edge of the tire. Accordingly, the larger the cross section of the stone and the shorter the lever arm resulting from the length of the stone, the more resistant it will be to tensile fracture.

FIG. 9 shows a pattern in which pairs of stones of the present invention arranged matingly to form an irregular hexagon. The square section that forms the tail, or L shape, of the stone, is joined to the hexagonal section. Were the square and hexagonal sections not integral, the square would be a separate element form the hexagon.

With separate sections, as an H-20 tire advances on the stone array across the longitudinal faces, a severe rotational or tipping action will develop on the first hexagon being traversed, and when the leading edge crosses the horizontal centerline of this hexagon, the 8" side footprint will thereafter load only 2" of a stone with a 5.66" diagonal dimension of each of the two cubes, for example, as it proceeds to the second hexagon. Thus, four stones will be contacted by the wheel and subjected to severe, eccentric loading. If the tire path is rotated 90° to the longitudinal direction, so as to cover only one line of cubes, each cube will become disproportionately loaded when the tire reaches the centerline of the array causing it to depress more than the two hexagons and the stones of the adjacent identical array. This is because the 10,400 lb. load is not uniform over the entire 8"×10" footprint, since tire shape is circular, as discussed and analyzed above.

By contrast, the stone of the present invention has each cubical appendage integral with the hexagon to create a rigidity that resists the deflection and rotational forces imposed by the tire at all times during the traverse.

Furthermore, with integral cubes and hexagons, when the direction of travel is longitudinal the resulting forces on the line of cubes that is formed from a layout of this array will be even worse, for the tire footprint will engage the extending corner of each cube first, and when the footprint becomes centered over the centerline of the cubes, the higher load level will be born on just two cubes. Here again the integration of the cube appendages with the hexagons of the present invention, which at this point have become loaded, albeit eccentrical, provides support and resistance to rotation.

With stones of my prior U.S. Pat. No. 4,544,305 and the Koelling patent, when an H-20 tire traverses the stones in some directions, 2 to 3 times or more of a tire will extend onto adjacent stones than with stones of the present invention. While parts of 10,400 lb. load not being borne by two stones in each array are being carried by adjacent stones, the unit load, i.e., per sq. in., will be much lower than at the tire footprint centerline, but the small loads on these corners will nonetheless tend to produce the adverse side effects of initiating rotation in at least four of the neighboring stones.

When the dual wheel is considered in its entirety, i.e., two 8"×10" footprints separated by a 4" space between, it can be seen that the stone of my prior patent would require five stones to carry the 20,800 lbs., even though only two are needed for a single tire. The Koelling patent's separate squares and hexagons would have eight of the small squares depressing more than the companion hexagons. Neither of these arrangements would retain their horizontal plane surfaces as well as the present invention.

If, to correct the foregoing discrepancies, the stones of my prior patent or of the Koelling patent are enlarged, the side dimensions would have to be increased such that the weight of each stone would be substantially increased.

Accordingly, the present invention provides a significantly more stable stone for heavy truck wheel loads. Two stones can fully carry the footprint of a single tire of a dual H-20 wheel, which the prior art stones cannot do. This in turn insures long-term integrity of the horizontal plane surface as well as minimal edge and main body fracturing. To achieve higher strength, the stones of prior art would have to be made much heavier, substituting one flaw for another.

Having described my invention, what is claimed is:

1. A paving stone capable of fully covering the ground or other like surface in a pattern formed with a plurality of stones of a single identical shape and size to support, individually and in cooperation with adjacent interlocked identical stones, heavy vehicular loads distributed through their tires over a plurality of stones in said pattern, said paving stone comprising:

a hexagonal section and a square section integrally formed of a single piece of ceramic material having a thickness less than half of the greatest dimension of the stone;

said hexagonal section having a periphery formed of six vertical faces, said six faces including four identical lateral faces and two identical longitudinal faces;

said four lateral faces disposed as two opposing pair of adjacent lateral faces with the lateral faces of each pair forming an internal angle of approximately 90° with the other, the lateral faces having equal lengths of from approximately 3½ inches to approximately 5 inches;

said two longitudinal faces each forming at opposite ends thereof an angle of approximately 135° with one of the lateral faces of each pair, to thereby define a hexagon, the longitudinal and lateral sides having lengths such that the length of the hexagon section from one 90° angle to the other is from approximately 9 inches to approximately 11 inches;

said square section having a periphery of four vertical faces each having a length equal to the length of the lateral faces of said hexagonal section, said square section having one of its vertical faces joined to one of the lateral faces of said hexagonal section with an adjacent lateral face on one side thereof lying in the plane of one of the lateral faces of the hexagonal section and an adjacent face on the other side thereof forming an internal angle of 135° with a longitudinal face of said hexagonal section;

whereby, pairs of identical ones of said stones are capable of being laid in a pattern with the longitudinal face of each that forms the internal 135° angle with a face of the square section lying proximate to each other, and with one face of the square section of each lying proximate to a lateral face of the hexagonal section of the other, to form a pair of cooperating load bearing interlocking paving stones having overall dimensions of from approximately 10 inches to approximately 14 inches by from approximately 11 ½ to approximately 14½ inches.

2. The slab element of claim 1, wherein each lateral face and each longitudinal face has an upper edge portion which is chamfered.

3. A ground or similar surface cover comprising a plurality of interlocking ceramic slab elements, each slab element including:

a hexagonal section and a square section integrally formed of a single piece of ceramic material having a thickness less than half of the greatest dimension of the stone;

said hexagonal section having a periphery formed of six vertical faces, said six faces including four identical lateral faces and two identical longitudinal faces;

said four lateral faces disposed as two opposing pair of adjacent lateral faces with the lateral faces of each pair forming an internal angle of approximately 90° with the other, the lateral faces having equal lengths of from approximately 3½ inches to approximately 5 inches;

said two longitudinal faces each forming at opposite ends thereof an angle of approximately 135° with one of the lateral faces of each pair, to thereby define a hexagon, the longitudinal and lateral sides having lengths such that the length of the hexagon section from one 90° angle to the other is from approximately 9 inches to approximately 11 inches;

said square section having a periphery of four vertical faces each having a length equal to the length of the lateral faces of said hexagonal section, said square section having one of its vertical faces lying adjacent one of the lateral faces of said hexagonal section, whereby another of the lateral faces of said square section lies in the plane of one of the lateral faces of the hexagonal section.

4. The ground or similar surface cover of claim 3 including a first plurality of said elements arranged in a first repeatable configuration, said first repeatable configuration comprising a first and a second of said interlocking slab elements each shaped substantially identically, and wherein the longitudinal faces of the hexagonal sections of each of said elements include a first longitudinal face adjacent a face of said square section and second longitudinal face, said first longitudinal face of said first slab element being located proximate to said first longitudinal face of said second slab element.

5. The ground or similar surface cover of claim 4 wherein a substantial number of said first pluralities of said first repeatable configuration are arranged such that any face of a slab element located proximate to a longitudinal face of another slab element is a longitudinal face.

6. The ground or similar surface cover of claim 3 including a second plurality of elements arranged in a second repeatable configuration, said second repeatable configuration comprising a first and a second of said interlocking slab elements each shaped substantially identically, and wherein one of said faces of said square section of said first slab element being located proximate to said lateral face of said hexagonal section of said second slab element next to the lateral face to which said square section of the second element is joined.

7. The ground or similar surface cover of claim 6 wherein in said second repeatable configuration said first longitudinal face of said first slab element is located proximate to said second longitudinal face of said second slab element.

8. The ground or similar surface cover of claim 7 wherein a substantial number of said second pluralities of said second repeatable configuration are arranged such that any face of a slab element located proximate to a face of a square section of another slab element is a hexagonal section lateral face.

9. The ground or similar surface cover of claim 7 wherein a substantial number of said second pluralities of said second repeatable configuration are arranged such that at least one square section face of one of said slab elements is located proximate to one square section face of another of said slab elements.

10. The ground or similar surface cover of claim 3 including a third plurality of a third repeatable configuration, said third repeatable configuration comprising a first and a second of said interlocking slab elements each shaped substantially identically, and wherein one of said faces of said square section of said first slab element is located proximate to said third lateral face of said hexagonal section of said second slab element.

11. The ground or similar surface cover of claim 10 wherein in said third repeatable configuration said first longitudinal face of said first slab element is located proximate to said second longitudinal face of the second slab element.

12. The ground or similar surface cover of claim 3 including a fourth plurality of a fourth repeatable configuration, said fourth repeatable configuration comprising a first and a second of said interlocking slab elements shaped substantially identically, and wherein one of said faces of said square section of said first slab element is located proximate to one of said faces of said square section of said second slab element.

13. The ground cover of claim 3 including a fifth plurality of a fifth repeatable configuration, said fifth repeatable configuration comprising a first and second of said interlocking slab elements each shaped substantially identically, and wherein the lateral faces of the hexagonal sections of said first and second slab elements opposite from the lateral faces to which the square sections of the elements are joined are adjacent.

14. The ground cover of claim 3 including a sixth plurality of a sixth repeatable configuration, said sixth repeatable configuration comprising a first and second of said interlocking slab elements each shaped substantially identically, and wherein the lateral face of the hexagonal section which is opposite to the lateral face to which the square section is joined to the first element is adjacent to the face of the square section of the second element which is opposite the face of that square section which is joined to the hexagonal section of that element.

15. The ground cover of claim 3 including a first plurality of said elements arranged in a seventh repeatable configuration, said seventh repeatable configuration comprising a first and a second of said interlocking slab elements each shaped substantially identically, and wherein the longitudinal faces of the hexagonal sections of each of said elements include a first longitudinal face adjacent a face of said square section and a second longitudinal face, said first longitudinal face of said first slab element being located proximate to said first longitudinal face of said second slab element;

whereby, pairs of identical first and second slab elements form cooperating load bearing interlocking pair of paving stones having overall dimensions of from approximately 10 inches to approximately 14 inches by from approximately 11 ½ to approximately 14½ inches.

16. The ground cover of claim 15 including a plurality of said seventh repeatable configurations arranged with respect to each other such that a second longitudinal face of a first slab element is located proximate to a second longitudinal face of a second slab element of another one of said seventh repeatable configurations.

17. The ground cover of claim 16 wherein any adjacent faces of a square section of a slab element of any of said plurality of said seventh repeatable configurations are located proximate lateral faces of slab elements of different ones of said seventh repeatable configurations.

18. An integrally formed tile-like slab element of cast ceramic material having:

a seven sided top face, a seven sided bottom face identical to but a mirror image of said top face and parallel thereto, and seven side faces each perpendicular to said top and bottom faces and each being rectangular, said seven side faces including first through seventh faces, the second, third, fifth and sixth faces having equal lengths of from approximately 3½ inches to approximately 5 inches, the first and fourth faces having equal lengths approximately one and one-half of the length of the second face and of from approximately 9 inches to approximately 11 inches, the seventh face having a length twice the length of that of the second face, said first face adjoining and forming an internal angle of approximately 135° with said second face, said second face adjoining and forming an internal angle of approximately 90° with said third face, said third face adjoining and forming an internal angle of approximately 135° with said fourth face, said fourth face adjoining and forming an external angle of approximately 135° with said fifth face, said fifth face adjoining and forming an internal angle of approximately 90° with said sixth face, said sixth face adjoining and forming an internal angle of approximately 90° with said seventh face, and said seventh face adjoining and forming an internal angle of approximately 135° with said first face.

* * * * *